US006742719B2

(12) United States Patent
Tudor et al.

(10) Patent No.: US 6,742,719 B2
(45) **Date of Patent: *Jun. 1, 2004**

(54) TWIN WIRE ELECTRIC ARC METALIZING DEVICE

(75) Inventors: Carl Frazer Tudor, Broek Op Langedijk (NL); Philip Mike Midgett, Broek Op Langedijk (NL)

(73) Assignee: International Metalizing & Coatings, Inc., Cherry Hill, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/082,052

(22) Filed: Feb. 25, 2002

(65) Prior Publication Data

US 2002/0074422 A1 Jun. 20, 2002

Related U.S. Application Data

(62) Division of application No. 09/519,593, filed on Mar. 6, 2000, which is a continuation of application No. PCT/NL98/00507, filed on Sep. 4, 1998.

(51) Int. Cl.[7] ..... B05B 1/24; B05B 7/02; B05B 1/28

(52) U.S. Cl. ..... 239/79; 239/80; 239/81; 239/83; 239/525; 239/526; 239/290

(58) Field of Search ..... 239/79, 80, 81, 239/83, 84, 296, 525, 526, 290, 291, 297, 300, 301, 533.6, 481; 219/76.14, 76.18, 76.16; 427/449

(56) References Cited

U.S. PATENT DOCUMENTS

| | | | | |
|---|---|---|---|---|
| 3,632,952 A | | 1/1972 | Rotolico | |
| 3,883,061 A | | 5/1975 | Thor | |
| 4,078,097 A | | 3/1978 | Miller | |
| 4,347,423 A | | 8/1982 | Katsube et al. | |
| 4,524,657 A | | 6/1985 | Griffith | |
| 4,536,632 A | | 8/1985 | Inoue | |
| 4,668,852 A | | 5/1987 | Fox et al. | |
| 4,720,044 A | | 1/1988 | Stemwedel, Jr. | |
| 4,853,513 A | | 8/1989 | Fuimefreddo | |
| 4,905,905 A | | 3/1990 | Hufgard | |
| 4,992,337 A | | 2/1991 | Kaiser et al. | |
| 4,993,642 A | | 2/1991 | Hufgard | |
| 5,245,153 A | * | 9/1993 | Singer et al. | 219/76.15 |
| 5,528,010 A | | 6/1996 | Herwig et al. | |
| 5,791,560 A | | 8/1998 | Rogers et al. | |
| 6,390,389 B1 | * | 5/2002 | Tudor et al. | 239/290 |

FOREIGN PATENT DOCUMENTS

| | | | | |
|---|---|---|---|---|
| CH | 213 068 | | 4/1941 | |
| EP | 0 339 650 | | 11/1989 | |
| EP | 0 522 438 | | 1/1993 | |
| SU | 1790452 A3 | * | 1/1993 | B05B/7/22 |

* cited by examiner

*Primary Examiner*—Davis Hwu
(74) *Attorney, Agent, or Firm*—Young & Thompson

(57) ABSTRACT

An electric arc metalizing apparatus includes a wire drive unit within a housing unit, a device for attaching at least two spools of wire within the housing unit such that the wire can be led through the wire drive unit, a spray gun spatially moveable with respect to the housing, the wire drive unit having at least one drive roller advancing the wire to the spray gun, the drive roller having a knurled surface engaging the wire for avoiding slippage and removing contaminations like corrosion layers, and within the housing unit at least one wire cleaning/lubrication mean position downstream from said drive unit.

19 Claims, 7 Drawing Sheets

TWIN WIRE ELECTRIC ARC METALIZING DEVICE

BACKGROUND OF THE INVENTION

The concept of metalizing or electroplating a surface has been known for years and has proven useful in protecting metal surfaces from corrosion. Buildings, railroad cars, bridges and all kinds of industrial equipment are subject to damage from the elements and the resulting corrosion can shorten the life expectancy of metal surfaces considerably. By providing a protective metal coating on the surface of these types of equipment, corrosion can be inhibited and many more years of use for the structure or apparatus can be achieved.

The present invention relates to means for metalizing various surfaces with a thin layer of a metal for protection against corrosion and the elements and means for carrying out the metalizing process. More specifically, the present invention relates to electric arc spray metalizing devices in which a pair of metal wire tips are brought close to each other at an intersection point within a spray gun component of the device. Each of the metal wires is electrified and an electric arc is created between the wire tips which melts the wire tips. A jet stream of air or another gas is focused at the intersection or arcing point, and the air then atomizes the molten metal at the wire tips and blows the molten particles into a spray stream that eventually deposits the atomized particles onto the substrate. The type of wire used is dependent upon the type of substrate to be coated and the thickness desired. The metalized coating protects the substrate from various external factors.

The procedure generally followed in arc spray metalizing is to first sandblast the surface to be treated in order to prepare it for coating. This, together with the creation of airborne metallic particles from the spray metalizing procedure itself creates a considerable amount of dust, grit and other airborne particles in the working environment. These can become attracted to the charged wires through differences in polarity and can clog both the housing where the wire spools are kept as well as the hollow cables through which the wire is directed to the spray gun. Due to the electrical nature of the process, the operator is also susceptible to electric shock and unless the arc/atomization process is carried out with a symmetrical spray stream, uneven metal deposition may occur on the substrate surface.

U.S. Pat. No. 4,720,044 to Stemwedel teaches an electric arc spray metalizing apparatus in which wire feed drive means are enclosed in a pressurized housing which shields the drive mechanism and other interior elements from the dusty environment. The wires are guided to the atomization point by hollow wire cables and these also carry the electric charge necessary for atomization. The '044 patent to Stemwedel provides a good insight into standard electric arc spray metalization apparatus and is hereby incorporated by reference.

U.S. Pat. No. 4,078,097 to Miller also teaches a metallic coating process wherein the metalizing spray is conducted through two frustoconical sleeves. An orifice plate is contained thereon in the housing and is contained within the pathway of the metal spray. The spray is propelled by a jet air stream that passes through small holes in the two sleeves and the orifice plate. The spray is propelled through the sleeves and orifice plate with such force that the particles adhere to the substrate upon impact.

U.S. Pat. No. 3,818,175 to Essers et. al. teaches and discloses a welding torch comprised of a housing with a contact tube through which the welding wire and electric current are fed to the handle of a gun. The electrode tip is comprised of a metal such as tungsten that has a high melting point and high resistance to dentition.

U.S. Pat. No. 3,546,415 to Morantz teaches an electric spray metalizing device in which a pair of wires are advanced to an arc-forming station, the molten wires being atomized by a gas jet forcing the particles away from the station. The metalizing spray gun has a novel wire feed means whereby the wires are automatically retracted away from the arc a predetermined distance when the metalizing process is turned off. This enables the wires to become properly positioned once the process is re-initiated.

U.S. Pat. No. 3,062,451 to Keshane et. al, U.S. Pat. No. 1,940,814 to Saeger and U.S. Pat. No. 2,876,330 to Reinhardt all disclose known embodiments of electric arc metalizing spray guns in which two wires are fed to a particular point where an electric charge melts the wires and a jet stream atomizes the molten metal into particles. Electric current is fed through or in association with the tubes that carry the wire feeds. Both the electric currents and the two wire leads meet at the atomization intersection and are melted and blown by a jet stream of air that also intersects at the point and forces the molten metal particles in a direction towards the surface to be metalized.

Whereas performance by the devices known in the art might be considered satisfactory, there are many problems inherent in the devices and the processes by which they are employed. Wire feed tubes and the wire drum housing units have been known to clog with dust and grit from the workplace, causing malfunctions. The known devices are not truly capable of uniformly depositing large surfaces areas of metalization. The present invention provides a solution to this end by using greater electrical energy in order to sustain a higher energy arc for consuming larger diameter wires. These large electrical energy requirements must be transferred and contained safely within the system in order to be effective and none of the prior art devices demonstrate an ability to provide such power. Use of greater voltages increases the risk of electrical shock and the devices known in the art even do not properly protect the operator from the lower voltages utilized therein.

The present invention improves upon the electric arc metalizing devices known in the art by making substantial changes to some of the basic components comprising said devices. More specifically, the present invention comprises an improved electric arc metalizing gun wherein a greater amount of electricity may be utilized in order to melt larger diameter wire cables which can then be atomized and dispersed onto the surface area to be coated so as to provide a uniformly coated surface of greater thickness and/or area. The present invention further includes improvements to the wire feed tubes, wire drives, housing and welding leads so that e.g. the greater electrical energy is safely disposed and evenly generated to the arc. The present invention provides easier electric arc metalizing operation through the elimination of clogging problems by protecting the interior components from the intrusion of dust and dirt particles. Other improvements allow for quicker, easier service of the machines all of which result in greater operating efficiency as will be seen in the more detailed description that follows. The improved design is also capable of being powered by an AC inverter which disperses the electricity evenly on both negative and positive legs for improved and more consistent arc. AC power is inherently more dangerous than DC and existing technology cannot utilize AC power. Use of AC power is not even suggested by the prior art.

SUMMARY OF THE INVENTION

An improved electric arc metalizing device allows for the controlled dispersion of atomized metallic particles that covers greater, more uniform surface areas of the subject to be coated. The welding leads and wire feed cables are preferably all encased in a rubberized housing that prevents electric shock and crossover and thereby allows for higher levels of electric energy to be transferred through the conductive wires. Preferably, the electric cable runs completely through the welding lead itself so that a greater charge may be used to melt wire of greater diameters. A preferred more streamlined air block of the gun channels and directs the forced air flow in a more concentrated elliptical pattern that provides a more evenly dispersed and uniformly deposited coating. An adjustable spray gun nozzle with multiple air ports allows for the application of different sized spray patterns. The unit is fully insulated for safety and can utilize AC inverted power. Knurled drive wheels are preferably incorporated to eliminate any slippage providing a more uniform arc. The knurled drive wheels remove contaminations like corrosion layers as well, improving transfer of electricity and the provision of a more uniform arc as well. The wire is contained inside the machine to eliminate the possibility of contamination. Each wire is preferably at least ⅛", more preferably at least 3⁄16" in diameter.

DETAILED DESCRIPTION OF THE INVENTION

The present invention comprises an improved electric arc metalizing spray gun for the deposition of a protective metal layer on specified surfaces. The metal so deposited may be any one of many that are known to be useful in protecting surfaces such as aluminum, copper, tin, lead and the like, possibly alloyed with relatively small traces of 5.0 wt % of each e.g. Sn, Pb, Si, P, Zr, Zn, Fe or Mn at the most. The metal preferably has a melting point below 4200° F. The invention itself is essentially an improved electric arc metalizing gun similar to those set forth in U.S. Pat. No. 4,720,044 to Stemwedel and U.S. Pat. No. 4,078,097 to Miller, both of which are herein incorporated by reference. These devices as known in the art, are comprised of a spray gun, a housing unit and a number of oversized cables connected at one end to the spray gun and attached at the other end to the housing.

The housing unit according to the invention contains a wire feed drive mechanism which preferably includes knurled drive wheels as a means for pushing a wire into the ends of each wire cable. A further cable comprises means for supplying compressed air from the interior of the housing to the gun for atomization of the molten metal and the forced expulsion of it through the nozzle head and onto the surface to be coated.

Like those devices of the prior art the electric arc metalizing device of the present invention is preferably comprised of a central housing unit which contains a control panel, wire feed drive means, the electric power source and a pressurized air source. According to an alternative, the electric power source and the pressurized air source can be provided at a distance from the housing unit. A rubberized hose preferably connects the housing with a spray gun assembly and contains the individual cables which carry the wire lead, the pressurized air flow and the power lines. Preferably the wire feed lines are further encased in teflon tubing which further guards against electrical shock and arcing. Preferably the cables themselves are attached to both the housing and the gun assembly by means of heavy duty quick connect outlets which permits fast assembly/disassembly of the system at the job site.

According to the invention, the housing unit preferably comprises a box like casing that preferably has connecting means for at least two electrical cables and at least one cable for compressed air at its back side and preferably connecting means for at least two electrical cables, at least two wire cables, at least one cable for compressed air and at least one control cable at its front side. The casing preferably has one or more access panels opening towards the sides, wherein the access panels give ease of access to the spools. An access panel preferably covers a side of the casing substantially completely. By hingedly connecting the access panel to the bottom of the casing, changing a spool is most convenient. The access to a spool for e.g. changing purposes is further enhanced if the access panel comprises at least part of the upper side of the casing as well. By letting the closed access panel rest with its free edges on continuous flanges according to a preferred embodiment, the inside of the housing unit is further protected against the ingress of contaminations. Preferably the flanges run along the edges, preferably the side and top edges, of both the front and back panel and are preferably directed inwards of the housing unit. The housing unit preferably comprises suspension means such that the housing unit can be suspended from e.g. a bridge to be treated with the system according to the invention. In a preferred embodiment, the suspension means comprise a beam element running from the front to the back. Said beam is preferably located on the central longitudinal axis of the housing unit, close to the upper side. To keep the weight of the housing unit as low as possible, such that it can be taken to virtually any site, it preferably contains no air filters or air driers. Those equipment is preferably connected to the housing unit through flexible hoses. An air drier is advantageous to get maximum metalizing effect. The housing unit is preferably supported by a swivel at each corner of its lower panel.

Preferably the gun assembly consists of a body or head portion, a nozzle and handle, which is grasped by the operator who points the nozzle at the surface to be metalized, operates a switch, preferably a trigger on the handle and essentially fires a stream of molten metal at the surface. As the molten metal strikes the surface, it instantly cools and a metallurgical bond is formed between the metal coating and the surface.

The use of higher voltage permits the use of thicker wires which in turn provides a greater stream of atomized metal for a larger coating spray. The ability to utilize greater voltage levels not only allows for the use of thicker wire leads, but also the atomization of denser metals for better coatings than ever before.

Preferably the metalizing gun is comprised of a handle, a body mounted thereon, and a dual supply cable which connects to the back of the body portion and contains the wire leads, pressurized air tube and the electric power leads. The cable is preferably attached to the gun by quick connect means which readily attach all five leads to the gun through simple attachment. Electric arc jumping, a persistent and dangerous problem that has plagued the devices known in the past state of the art is eliminated. The body is preferably made of galvanic isolating material such as Teflon. A control cable runs from the housing unit to the gun such that the wire feed driving mechanism can be remotely controlled. The control cable is for ergonomic reasons preferably connected to the back of the body, preferably running through the body to a trigger at the handle, such that the operator can easily switch the system on and off.

The added safety features afforded have allowed for the incorporation of larger electric power cable which allows for the use of higher voltages in AC or DC which can then melt wire cables of greater diameter or thickness. The two wire feed cables preferably enter the rear of the body of the gun and are charged as they intersect electrical contacts in juxtaposition with the power cable. In the cases of DC power, the two wire leads become oppositely charged, one positive, one negative and are fed through copper wire shoots within the nozzle. The two wire leads intersect at an arcing point where the charges meet and melt the wire. It is at this arcing point that wire, electricity and air flow meet to force the metal particles out of the air ports and onto the substrate.

The gun assembly is preferably provided with a direct air flow through the gun that allows for the adjustable selection of different sized barrel ports from which the metalizing spray exits. By changing the air pressure, different fan patterns can be selected which provide the metalizing spray pattern to form 1" to over 12" in a symmetrical, elliptical shape. Preferably the gun is also provided with an increased number of operable air ports than is known in the art and these allow for greater air flow forcing the molten metal through the barrel parts and consequently greater explosive force forcing the molten metal out of the nozzle. This again not only increases the amount of wire that can be sprayed but increases the bonding capability and diversity of the material as well.

The nozzle also comprises a recessed barrel which allows for the metalized air stream to flair outward resulting in an elliptical spray dispersion. This, in conjunction with the ability to use thicker, larger, or denser metal wires provides an even better distribution of metallic coating that also carries a greater surface area for quicker application and faster job time.

The gun assembly preferably comprises additional safety features such as a switch lock to prevent accidental firings, a locking ring head holder to prevent the unintentional movement of the nozzle from one air jet setting to another, and a lock screw for the prevention of inadvertent wire feed. The wire feed lines preferably terminate as copper wire shoots which are straight and not curved as metalizing guns known in the art are traditionally constructed. The copper wire shoots allow for different sized wires to be utilized for different applications and the straight line feed cuts down on resistance against the wire as it passes through the atomization. This cuts down on burring, a phenomena whereby the wire is chafed by the lining of the guide lines and shoots causing particles of wire to scrape off. Over time, these particles can aggregate clogging the feed lines, nozzle, and shoots. This also can result in cross-arcing whereby the electric charge that melts the wire "jumps" out of the arc to another nearby point of attraction resulting in shock and flash burns. The straight design of the copper wire shoots together with the streamlining of the wire feed tubes cuts down on this resistance and thereby prevents burring and the electrical hazards that result.

The preferred multiple air ports are preferably symmetrically arranged about the copper wire shoots so as to provide a concentrated force of impact at the arcing point where the air jets and wires simultaneously meet. The preferred adjustable barrel ports are preferably positioned just beyond the arc point and thereby control the size of the stream that is sprayed upon the surface. This allows the operator to tailor the size and force of the metalizing stream to the surface or object to be coated providing a more uniform coating with a stronger bond thereto.

Within the central housing unit is preferably a knurled wire drive means which pushes the wire cable to be electrified and pushed through the cables within the teflon tubes to the spray gun assembly. The motor and wire drive wheels can possess an automatic reverse mechanism whereby the wire can be immediately recoiled, thereby shutting down the process and preventing injury should a problem develop. Apart from the standard wire drive wheels and motor assembly which are known in the art, the wire drive means of the present invention further can comprise a pair of wire cleaners with oil lubricators which not only insure that the wire to be atomized is not only uncontaminated but readily moves through the cables to the gun assembly. This eliminates the necessity of a pressurized housing as disclosed in U.S. Pat. No. 4,720,044 in order to keep any atmospheric or environmental particles from clogging the feed lines and central housing. Clean, uncontaminated wire is also necessary to eliminate popping, a condition whereby the foreign particles or dirt interfere with the electric flow in the wires and arc and cause the metalizing process to sputter. This results in a more efficient, safer operation.

The ability to use larger wire diameters than before allows for greater electrical energy to be supplied at the arcing point for greater melting temperatures thereby increasing the adhesion properties of the molten metal to the substrate. Knurled drive wheels insure that an improper arc will not develop from e.g. wire slippage or a corrosion layer on the wire. The number of drive wheels for each wire to be driven by the wire drive means is preferably limited to two, which limitation is allowed for by the provision of at least one knurled drive wheel. For improved driving power, it is preferable to have one of the drive wheels directly driven by the output shaft of the drive motor. This feature allows for limitation to two drive wheels as well. The combination of direct driven drive wheels and knurled drive wheels allows for the greatest improvement in e.g. reliability of wire feed.

Wire straighteners insure that the wires are not bent or kinked as they enter the feed cables and are guided smoothly to the copper wire shoots where they are electrified and atomized. The smoother, straightened wire permits less burring and again this not only improves efficiency but safety as well.

The control equipment is preferably contained in a sealed box within the housing unit such that contamination is prevented. The control equipment preferably comprises means for starting and stopping and eventually reversing the motor drive of and speed controls for the wire drive means, but can contain switches for switching on and off the electrical power and/or the pressurised gas as well.

Preferably, there is a pull cable connected to the housing unit. This cable is preferably connected to the gun as well. The length of the pull cable is preferably shorter than the wire, electricity and air cables (service cables) running between the housing unit and the gun. By using the pull cable to move the housing unit, the service life of the service cables is improved, bending or knicking of the metal wires is avoided. The pull cable can possibly be incorporated in one or both of the electricity cables.

Preferably the wire spools are arranged such that they generate a magnetic field that pulls the access panel tight, for which reason the access panel has preferably a poor flexural stiffness, e.g. by having a flat, plate metal (e.g. steel) panel. This feature is further explained by the embodiment of FIG. 1. Preferably the electrical cables have no connectors between the power supply (e.g. rectifier) and the gun, allowing for even higher power and low power loss. For this reason they preferably extend outside the housing unit.

Swivel casters preferably support the housing unit, allowing for improved manoeuvrability. Preferably, all switches are provided in a water proof box on the outside of the housing unit, improving their accessibility while maintaining their proper shielding from the harsh environment. Preferably, provisions are made to the housing unit to suspend it e.g. under a bridge to be metalized. Suspension means like a suspension bolt, e.g. projecting through a hole in the housing unit outer wall, can be provided for this purpose, that is preferably removably connected to a beam within the housing unit.

The equipment is preferably connected to a power source of approximately 1000 Amp. Depending on type of source (A.C. or D.C), the voltage is preferably between approximately 20 and 70 Volts or at least approximately 220 Volts.

This equipment allows for e.g. spraying two different wire types at one time, such as the one wire being aluminum based and the other e.g. zink based, forming an instant Al—Zn alloy during spraying. For ease of changing wires or wire guides, the wire drive means are conveniently provided with wing bolts for improved accessibility.

AT PRESENT PREFERRED EMBODMENTS

List of Parts

Figure 1:
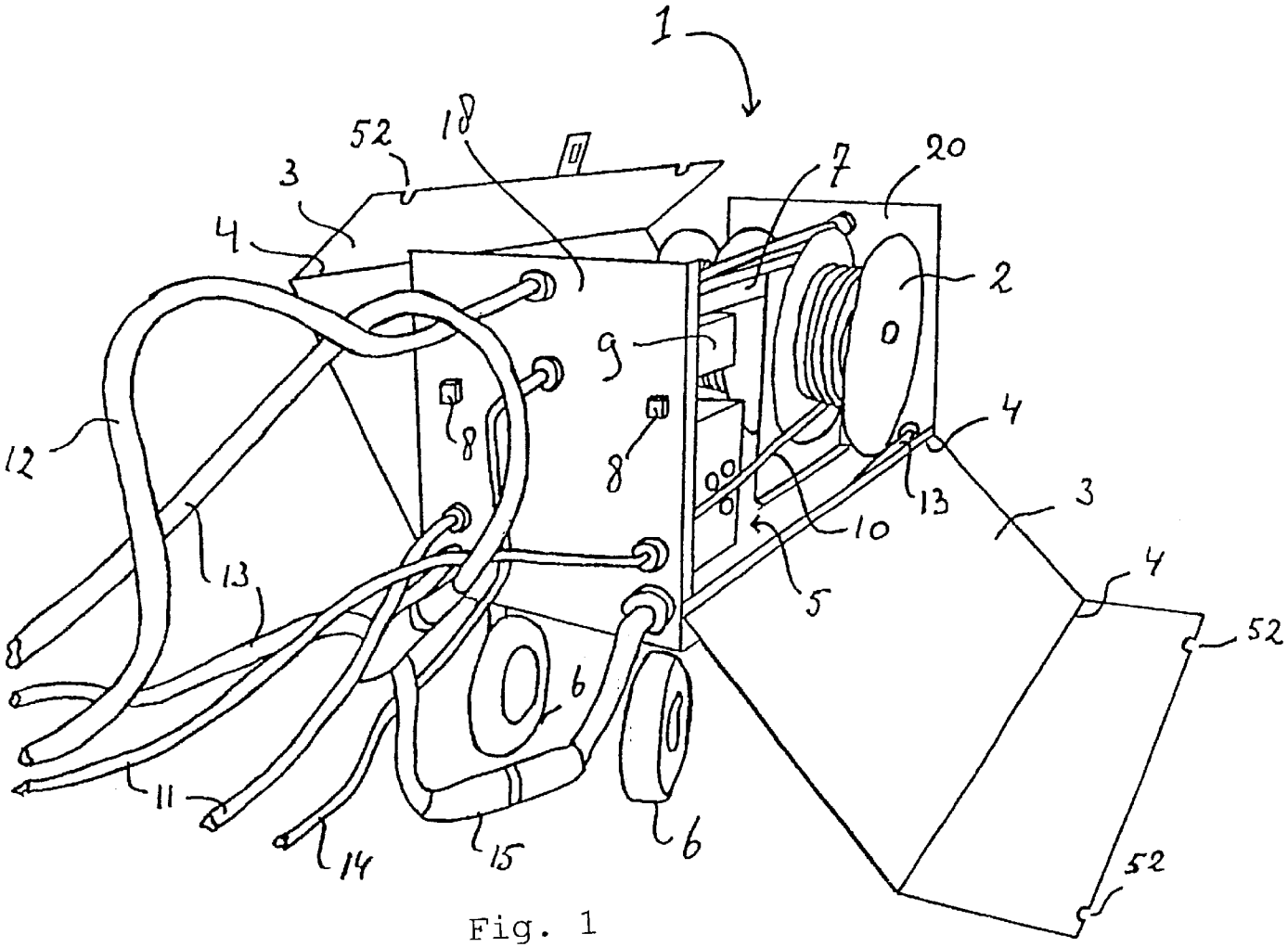
FIGS. 1 and 2 show the housing unit in two different perspective views.
Figure 2:
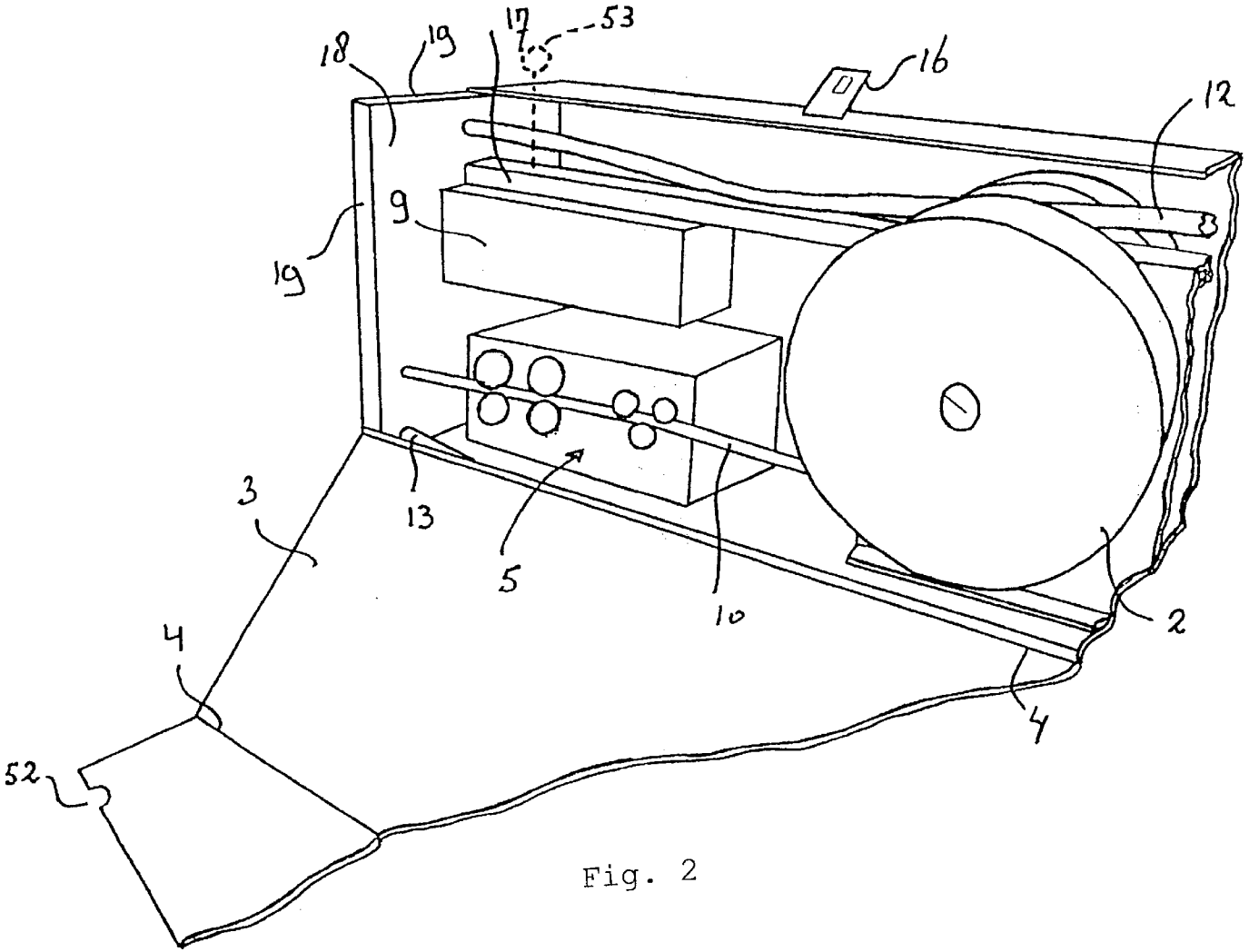

| | |
|---|---|
| 1 | housing unit |
| 2 | spool |
| 3 | access panel |
| 4 | hinge |
| 5 | drive means |
| 6 | swivel wheel |
| 7 | suspension beam |
| 8 | switch |
| 9 | control box |
| 10 | wire |
| 11 | wire cable |
| 12 | air cable |
| 13 | electrical cable |
| 14 | control cable |
| 15 | quick connector |
| 16 | lock |
| 17 | beam |
| 18 | front panel |
| 19 | flange |
| 20 | back panel |
| 21 | roller |
| 22 | wire straightener |
| 23 | control |
| 24 | lever arm |
| 25 | lock of lever arm |
| 26 | tilted lever |
| 27 | drive roller |
| 28 | driven sprocket |
| 29 | drive sprocket |
| 30 | wire guide |
| 31 | gun |

-continued

| | |
|---|---|
| 32 | handle |
| 33 | nozzle |
| 34 | body |
| 35 | insulated tube |
| 36 | control switch |
| 37 | air deflector |
| 38 | holding ring |
| 39 | contact |
| 40 | shoot |
| 41 | hole in contact |
| 42 | hole in body |
| 43 | air channel |
| 44 | conduit |
| 45 | annular space |
| 46 | shield |
| 47 | tip guide |
| 48 | jacket |
| 49 | screw |
| 50 | recessed barrel |
| 51 | wire cleaner |
| 52 | hole |
| 53 | suspension hook (removable) |

First, the embodiment according to FIGS. 1–6 is described:

The position of the roller 21 is adjustable by the control 23 to straighten the wire 10. The outer peripheral shape of each roller 21 and 27 has an indented configuration such as a U-shaped or V-shape to channel and direct the wire across each roller. The indent of the drive rollers 27 are knurled for e.g. improved grip. The grip is further controlled by tightening or loosening the lock 25. The drive sprocket 29 meshes with the sprockets 28 of the two lower rollers 27, which latter mesh with each one sprocket 28 of the upper rollers 27, such that all rollers are positively driven.

The conduit 44 supplies some air to the air deflector 37 through the annular space 45. The air deflector 37 directs air in a region beyond the main exit of the air channel 43 to give the spray pattern an elongated shape.

The metal contacts 39 are completely embedded in the body 34 and thus completely shielded from the environment. They are bar shaped and extend to bridge the level between a wire 11 and an electrical cable entering the body at one side of the air cable 12, such that both the wire 11 and the electrical cable 13 cross said contact 39. In this way the shoot 41 is charged through the contact 39. Different from what is shown in the drawings, the tube 35 preferably directly connects to the body 34, or some other insulating element bridges the gap between the tube 35 and the body 34 such that the shoot 40 is completely shielded from the environment, eliminating sparking risks and protecting the operator against shocks with e.g. A.C. supplies. The jacket 48 electrically insulates the nozzle 33 from the shoot 40. Apart from the drawing, to further avoid unwanted sparking and protect the operator against shocks, the shoot 40 preferably ends within the body 34 at a distance from the nozzle 33 and preferably ends at the circumference of the contact 39. Then the jacket can be eliminated.

Preferably no elements other then those for connecting the cables and the nozzle 33 are present on the outer surface of the body 34 to further avoid shocks or sparking. The holding ring 38 is preferably embedded into the material of the body 34 as well, such that no screws or other fastening elements need to project into the body to mount the ring 38, thus further improving the insulating properties of the gun assembly 31.

The control cable 14 connects to the back of the body 34 just below the switch 36.

Figure 6:
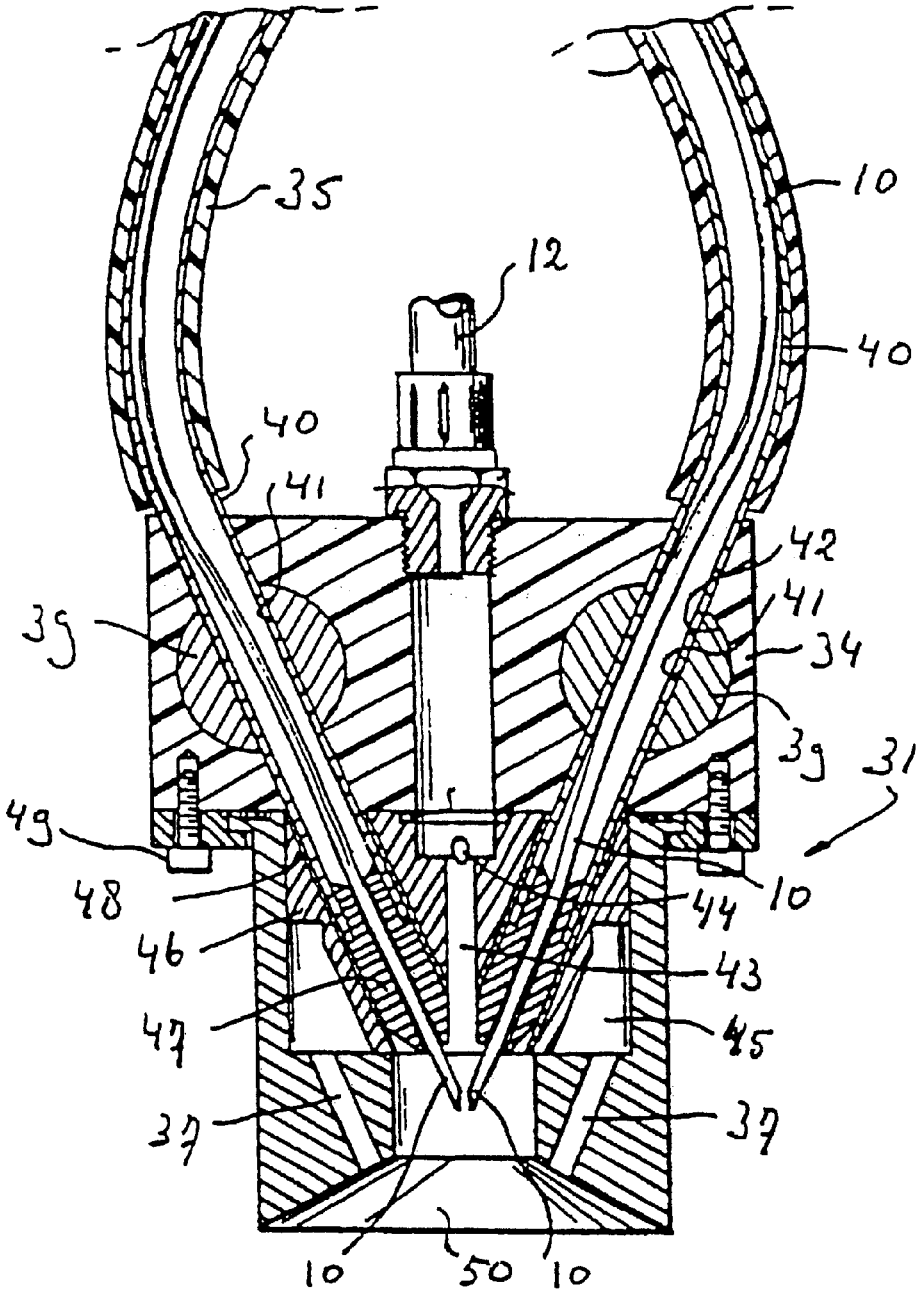
FIG. 6 shows the gun in section along the line VI—VI in FIG. 4.
Figure 7:
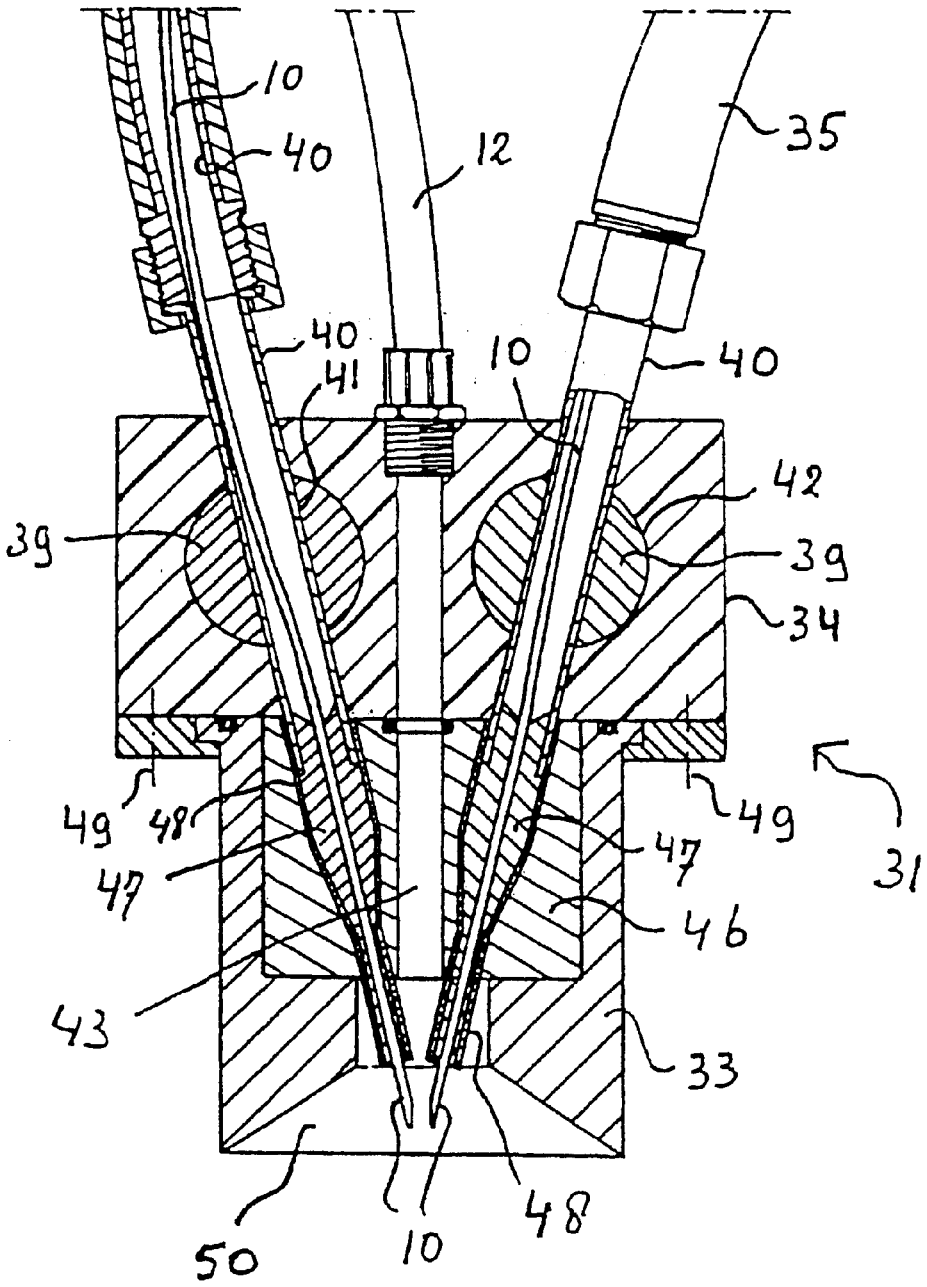
FIG. 7 shows an improved gun in a view according to FIG. 6.

In the improved gun 31 of FIG. 7, the differences with the embodiment of FIG. 6 are as follows: The tip guides 47 and jackets 48 extend into the air stream from the the air channel 43 such that the wire tips are always in an air flow, improving their cooling. The tip guides and jackets preferably end such that the wire tips end in the recessed barrel 50, further improving the cooling efficiency. These arrangements of the tip guides and jackets e.g. avoid clogging of the air channel with molten wire drops as well, e.g. when feeding and electrifying the wire without turning on the air stream, at least improving the convenience of the gun. The air channel 43 is substantially unrestricted from the air tube 12, allowing for higher air pressures that are preferred when using thicker wires. The air deflectors 37 have been eliminated such that all air is available for spraying the molten metal. However, air deflectors 37 can be added in e.g. the way as shown in FIG. 6, if required (i.e. with the annular space 45 and the conduit 44). Compared to FIG. 6, the shoots 40 are straighter and have a smaller mutual inclination (i.e. approximately 50° in the case of FIG. 6 and approximately 20° and preferably smaller than approximately 35°, more preferably smaller than approximately 25° in the case of FIG. 7). The part of the shoot 40 projecting from the back of the gun 31 is preferably properly covered with insulating material, including the quick connectors to the insulated tube 35.

Figure 3:
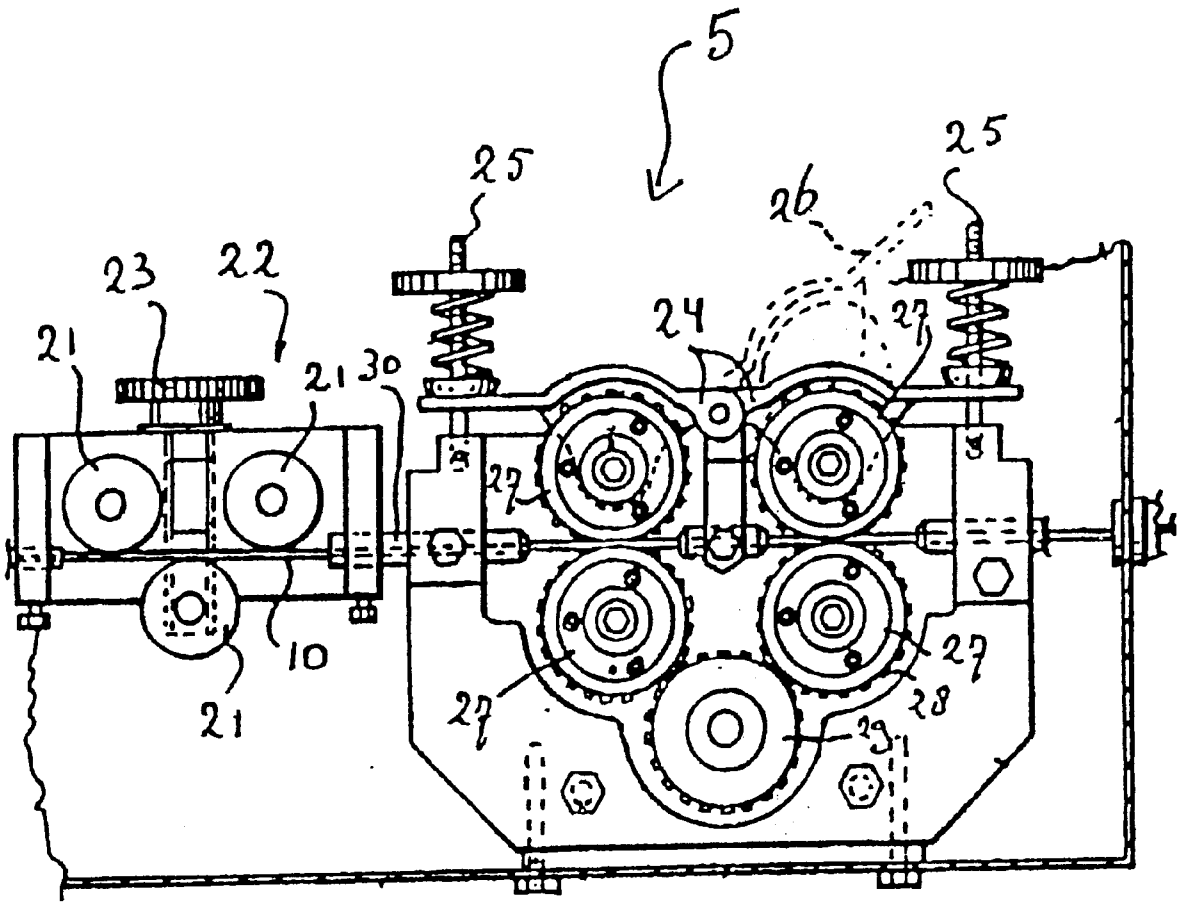
FIG. 3 shows the drive means in side view.
Figure 4:
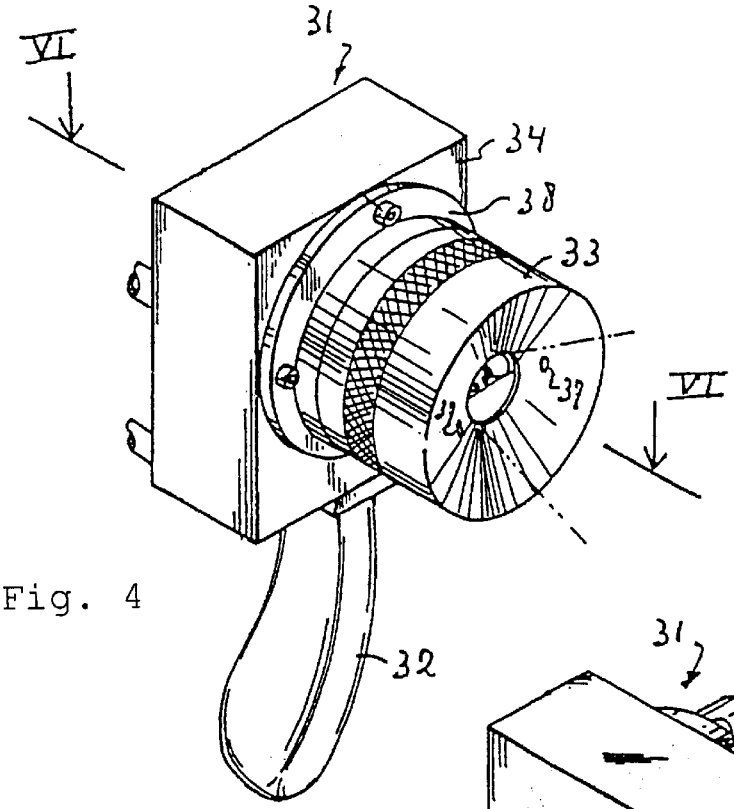
FIGS. 4 and 5 show the gun in two different perspective views.
Figure 5:
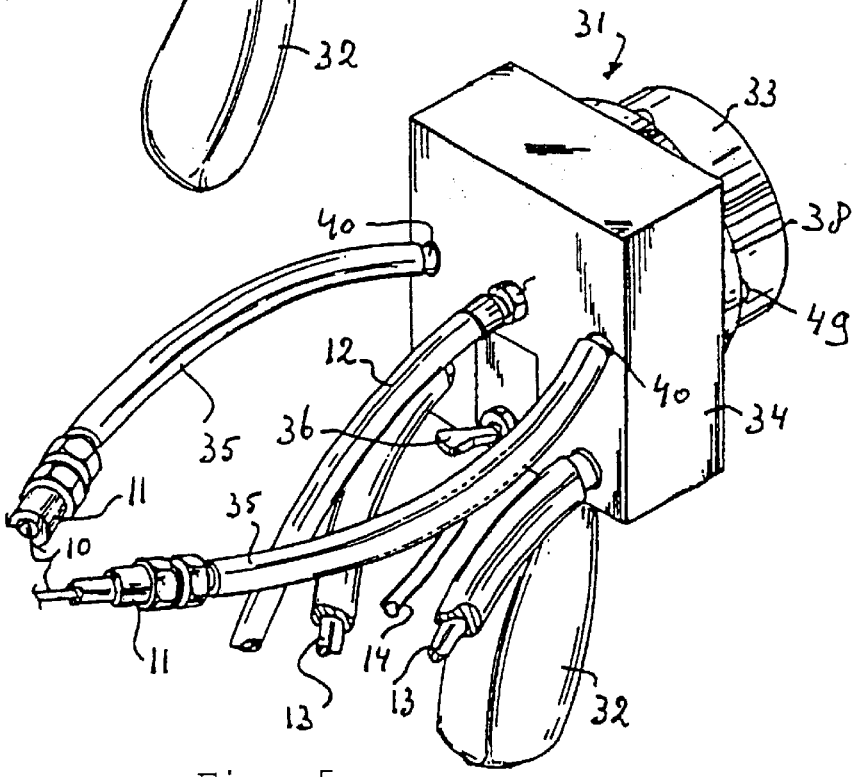
Figure 8:
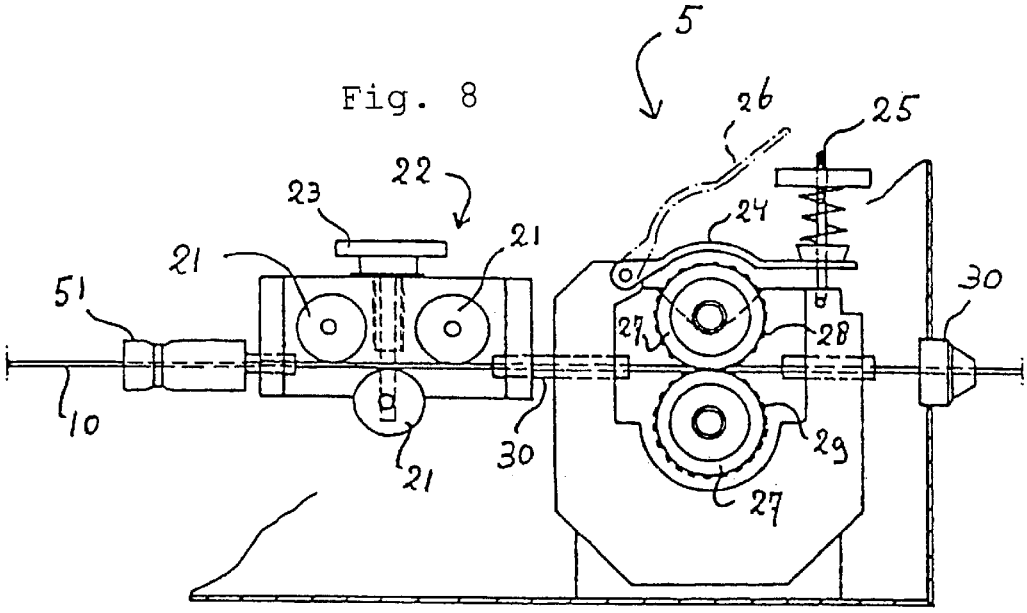
FIG. 8 shows an improved drive means in side view.

In the improved wire drive means of FIG. 8, the differences compared to FIG. 3 are as follows: There are merely two drive rollers 27. The lower drive roll 27 is directly driven by the output shaft of the motor. The drive sprocket 29 and driven sprocket 28, allowing for active drive power for the upper drive roll 27, are co-axial with the respective drive roll 27, as is the case in the embodiment of FIG. 3 as well. A wire cleaner 51 is added. This is preferably from foamlike or sponge material. The wire cleaner 51 is preferably wrapped around the wire 10 and e.g. kept in place by a strap. A convenient cleaning compound, such as a grease, is preferably deposited on the surface facing the wire 10. This wire cleaner can be provided for the embodiment of FIG. 3, or other embodiments as well.

Figure 9:
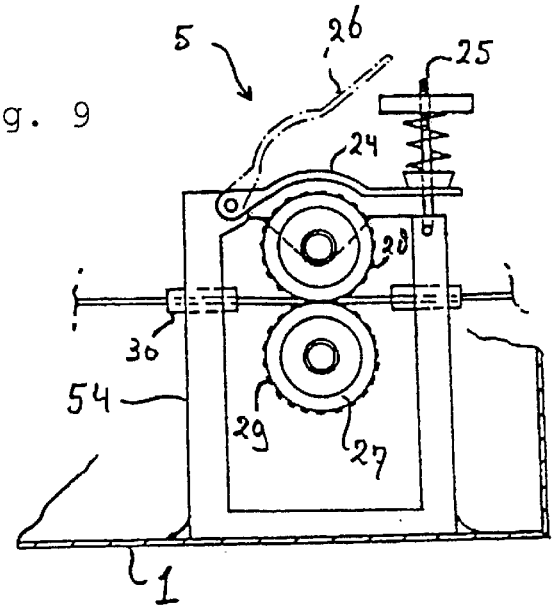
FIG. 9 shows a modified form of the structure of FIG. 8.

FIG. 9 shows a side view of a further embodiment for the drive means 5, that has a unitary metal frame 54 bearing the lever arm 24 for moving the upper wheel 27 towards and away from the lower wheel. The wire guides have a low friction, electrical isolating surface (like plastic, e.g. Teflon) engaging and guiding the wire 10. This two wheel drive means 5 allows for improved alignment and thus lower friction for the wire 10. The unitary frame 54 has enhanced stability and does not suffer from becoming flexible due to loosening of fasteners (bolts or screws) while in use. The wheels 27 are mounted to electrical isolating discs at their back, fastened to the relevant shaft. The frame 54 is mounted, preferably welded, to the bottom plate of the housing unit 1.

It is recognized that minor changes and variations can be made to the apparatus of the present invention that have not been detailed or specifically set forth above in the specification or drawings. Where any such changes do not materially change the invention as herein described, such embodiments are considered to fall within the spirit and scope of the invention as recited by the claims that hereafter follow.

What is claimed:

1. An electric arc metalizing apparatus comprising:

a housing unit;

a spray gun spatially moveable with respect to said housing and connected to said housing by supply cables to supply wire, electrical energy and pressurized gas thereto;

a wire drive means within said housing;

a means for attaching at least two spools of wire within said housing unit such that the wire can be led through said wire drive means;

said wire drive means having at least two drive rollers advancing said wire to said spray gun, said drive rollers each having a knurled surface engaging the wire for avoiding slippage thereof and removing contaminations therefrom.

2. The apparatus of claim 1, wherein the knurled surfaces of the drive rollers engaging the wire remove corrosion layers from the wire.

3. The apparatus of claim 1, wherein, said wire drive means further comprises a drive motor with an output shaft, and at least one of the drive rollers are directly driven by the output shaft of the drive motor.

4. The apparatus of claim 1, further comprising, within said housing unit, at least one wire cleaning/lubrication means positioned downstream from said drive means.

5. The apparatus of claim 1, wherein said wire drive means comprises exactly two drive rollers advancing said wire to said spray gun, each of the drive rollers having knurled surfaces engaging the wire.

6. The apparatus of claim 1, wherein, there is within said housing unit at least one wire cleaning/lubrication means positioned either immediately before or downstream from said drive means, and the housing unit has an access panel opening towards the side, at least partly closing the top side of the housing as well and hingedly connected to a region of the bottom of said housing and closing against flanges of rigid parts of the housing.

7. The apparatus of claim 6, wherein the at least one wire cleaning/lubrication means is positioned immediately before said drive means.

8. The apparatus of claim 1, wherein the housing unit contains a longitudinally extending suspension beam located near the top side.

9. The apparatus of claim 1, wherein said spray gun contains wire shoots guiding said wire through said spray gun and running substantially straight through said spray gun and making a mutual angle between 0° and approximately 35°.

10. An electric arc metalizing apparatus comprising:

a ground-supported housing unit;

a remote, hand-held spray gun spatially moveable relative to said housing unit and connected to said housing by elongate flexible members comprising at least two supply cables to supply wire to said spray gun;

a wire drive means within said housing;

a means for attaching at least two spools of wire within said housing unit such that said wires can simultaneously be led through said wire drive means;

said wire drive means having two sets of drive rollers, each set of drive rollers having at least two opposing drive rollers forming a nip containing an associated one of said wires, said two wires being simultaneously advanced by the drive rollers towards said spray gun by pushing each said wire through an associated flexible wire supply cable;

said opposing drive rollers, of each said set of drive rollers, having a knurled surface engaging said wire for avoiding slippage thereof and removing contaminations and corrosion layers therefrom while pushing the wire forward, wherein, said housing unit includes, for each wire, a means for straightening said wire coming from said spool, said straightening means is located upstream from said wire supply cable, and said wire drive means further comprises a drive motor with an output shaft with at least one of said knurled drive rollers of each said set of drive rollers being directly driven by said output shaft of the drive motor.

11. The apparatus of claim 10, wherein, said straightening means is located upstream from said wire drive means.

12. An electric arc metalizing apparatus comprising:

a ground-supported housing unit;

a remote, hand-held spray gun spatially moveable relative to said housing unit and connected to said housing by elongate flexible members comprising at least two supply cables to supply wire to said spray gun;

a wire drive means within said housing;

a means for attaching at least two spools of wire within said housing unit such that said wires can simultaneously be led through said wire drive means;

said wire drive means having two sets of drive rollers, each set of drive rollers having at least two opposing drive rollers forming a nip containing an associated one of said wires, said two wires being simultaneously advanced by the drive rollers towards said spray gun by pushing each said wire through an associated flexible wire supply cable;

said opposing drive rollers, of each said set of drive rollers, having a knurled surface engaging said wire for avoiding slippage thereof and removing contaminations and corrosion layers therefrom while pushing the wire forward.

13. The apparatus of claim 12, wherein said housing unit further comprises, for each wire, a straightening means, upstream from said wire supply cable, for straightening said wire coming from said spool.

14. The apparatus of claim 13, wherein said straightening means are located upstream from said wire drive means.

15. The apparatus of claim 12, wherein said wire drive means further comprises a drive motor with an output shaft with at least one of said knurled drive rollers of each said set of drive rollers being directly driven by said output shaft of the drive motor.

16. The apparatus of claim 12, wherein said wire drive means further comprises, for each wire, a cleaning and lubricating means for cleaning and lubricating said wire coming from said spool.

17. The apparatus of claim 16, wherein said cleaning and lubricating means is wrapped around said wire.

18. The apparatus of claim 16, wherein said cleaning and lubrication means is made of a foam material.

19. The apparatus of claim 12, wherein said at least one of said spools contain aluminum wire.

* * * * *